US005791103A

United States Patent [19]

Coolman et al.

[11] Patent Number: 5,791,103

[45] Date of Patent: Aug. 11, 1998

[54] POURING BUCK

[75] Inventors: David W. Coolman, Plymouth; Eugene Sawyer, Shawano, both of Wis.

[73] Assignee: PLYCO Corp., Elkhart Lake, Wis.

[21] Appl. No.: 785,751

[22] Filed: Jan. 18, 1997

[51] Int. Cl.[6] ..... E06B 1/04

[52] U.S. Cl. ..... 52/215; 52/576; 249/39; 249/134; 249/142

[58] Field of Search ..... 52/215, 366, 367, 52/375, 656.9, 656.4, 656.5, 576; 249/134, 142, 150, 39

[56] References Cited

U.S. PATENT DOCUMENTS

| | | | |
|---|---|---|---|
| 2,787,820 | 4/1957 | Shields et al. | 249/39 X |
| 3,380,218 | 4/1968 | Fabich | 52/656.4 |
| 3,426,482 | 2/1969 | Mock | 52/656.4 X |
| 3,737,266 | 6/1973 | Yamamoto | 249/134 X |
| 3,782,054 | 1/1974 | Goss, Jr. | 52/656.9 X |
| 3,995,843 | 12/1976 | Kasteler | 249/30 X |
| 4,430,831 | 2/1984 | Kemp | 249/39 X |
| 4,589,624 | 5/1986 | Jones | 52/215 X |
| 4,665,676 | 5/1987 | Drzemala, deceased | 52/656.9 |

*Primary Examiner*—Creighton Smith

*Attorney, Agent, or Firm*—Francis J. Bouda; Donald J. Ersler

[57] ABSTRACT

The window buck is made of extruded irregular shapes consisting of a combination of cellulose and polymer compounded specifically to be used in connection with building walls of poured concrete. The combination desirably is a mixture of approximately 70% cellulose and approximately 30% polymer. The cellulose is preferably sawdust, and the polymer preferably is polyethylene.

5 Claims, 2 Drawing Sheets

POURING BUCK

FIELD OF THE INVENTION

The present invention relates to a pre-formed frame or "buck" which is placed in the wall of an industrial or residential building, and which provides an opening into which a window can be installed.

Although most windows in buildings include not only the window glass panels and the window frame into which the panels can be mounted, generally the window frame is not strong enough to provide the protection and rigidity for the windows after the building is completed and the walls are formed around the window opening.

Therefore, a rigidifying box or frame called a "buck" is formed or built to provide a receptacle in the opening into which the window and window frames can be mounted.

In many made-to-order or "stick" building constructions, the window buck is built up from 2×4's or similar members by the carpenter.

In the more modern construction where entire walls can be pre-fabricated, either off-site or on-site, the buck quite often is a pre-formed rectangle which is fitted into the appropriate position on the wall.

Even more recently, the construction of buildings has included the formation of walls by pouring concrete into forms or molds, and although this has long been done in the preparation of basement walls, such poured concrete walls can be created both off-site and on-site and the entire wall can be tilted into a vertical position and installed on-site as a completed unit.

Therefore, the buck of the present invention is called a "pouring buck", and the concrete, when poured into the frames or moulds to form the walls, flows into position around the outside edges of the pouring buck, and when the concrete sets, the windowbuck is firmly in place.

BACKGROUND OF THE INVENTION

Pouring bucks, per se, are not new, but in the past the pouring bucks have been made either of steel frames and forms or of wood, and in each instance there has been a specific and distinct disadvantage.

The metal pouring bucks in the past, made either of aluminum or steel, not only created temperature-conducting devices which have a disadvantage of disaffecting the heat-controlling system of the building, but also tended to contract or expand as the temperature changes.

On the other hand, the pouring buck made of wood tended to absorb the moisture from the concrete and could easily warp and also have the disadvantage of deteriorating, particularly if the wall was a basement wall and a great portion thereof surrounded by moisture-containing earth. Removable steel or aluminum pouring bucks used for warm widows added the problems of insertion, removal, storage and cleaning.

SUMMARY OF THE INVENTION

The pouring buck of the present invention overcomes the disadvantages of metal and wood pouring bucks because it is constructed of a composite material including ground wood, such as sawdust or wood chips and a synthetic polymer.

The pouring buck of the present invention can thus be created easily and inexpensively by pouring or extruding the composite of sawdust and polymer into an appropriate mold and then after the material has been cured or set, the pouring buck of the present invention is ready to be inserted into the appropriate space in the wall prior to the pouring of the concrete and provides the extraordinarily strong, warm and heat-insulating characteristics so desired and which are not provided by the pouring bucks of the prior art.

The formulation of the composite material can be chosen with varying ratios of sawdust and polymer and with appropriate colors and with a mold having desirable surface characteristic or appearance. For instance the surface of the mold in which the composite material is poured can be created to look like concrete and, therefore, the pouring buck of the present invention becomes, from a visual standpoint, more appropriately an integral part of the concrete wall.

OBJECTS OF THE INVENTION

Thus an object of the invention is to provide a pouring buck for windows or door openings in poured concrete walls which overcome the disadvantages of metal-pouring bucks or wood-pouring bucks.

Another object of the present invention is to provide a pouring buck which can be created off-site and installed by the contractor or carpenter easily and effectively and thus reduce the cost of building construction.

Still another object of the present invention is to provide a pouring buck which looks like a concrete member but is strong and warm and also heat-insulatable and resists deterioration.

With the above and other objects in view, further information and a better understanding of the present invention may be achieved by referring to the following detailed description:

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

BRIEF DESCRIPTION OF THE DRAWINGS

In the drawings, wherein like reference characters indicate like parts.

DESCRIPTION OF THE PREFERRED EMBODIMENT

Figure 1:
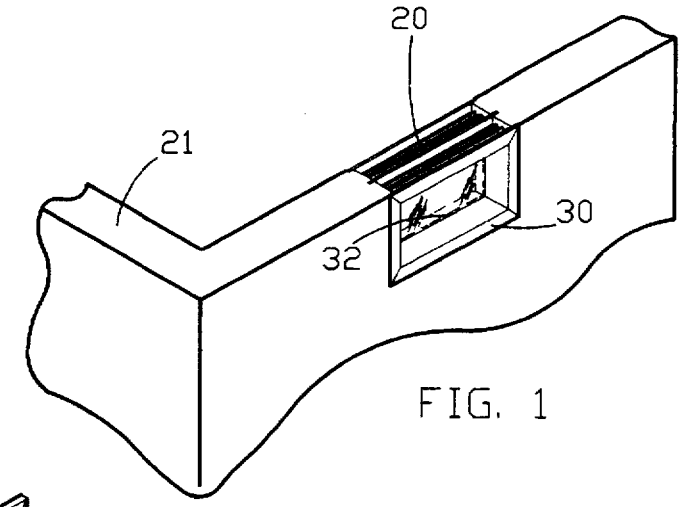
FIG. 1 is a perspective view of a poured concrete wall including the pouring buck of the present invention.

Referring now to FIG. 1, a pouring buck 20 is shown in position in a concrete wall 21.

Figure 2:
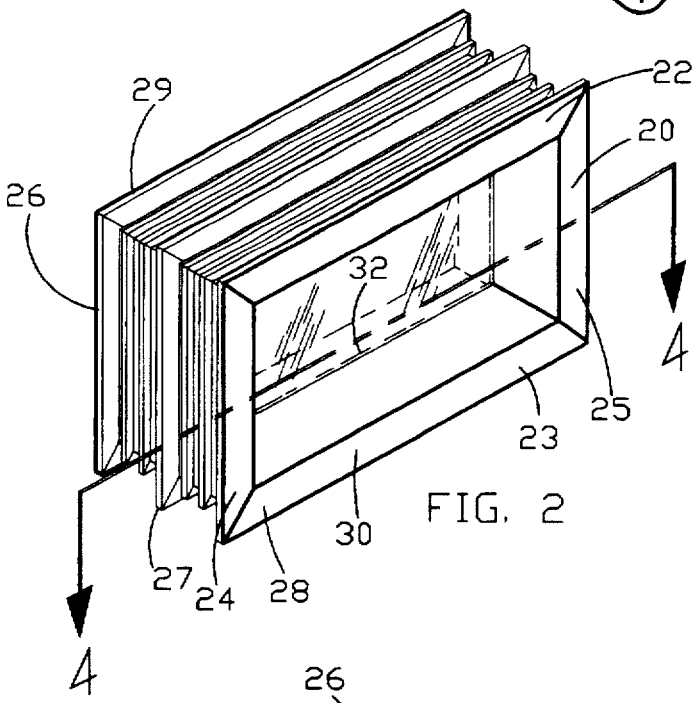
FIG. 2 is a perspective view of the pouring buck of the present invention.
Figure 4:
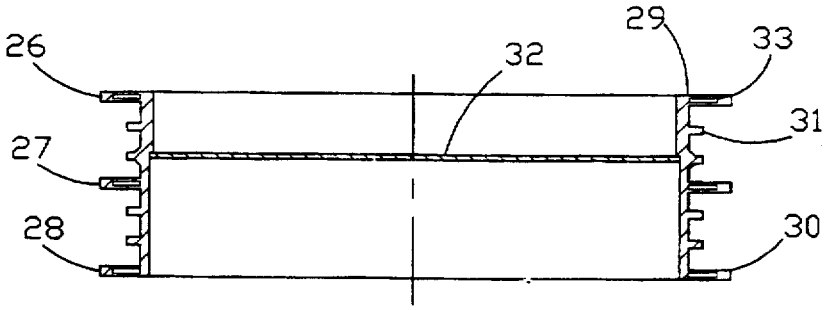
FIG. 4 is a horizontal cross-sectional view taken generally along line 4—4 of FIG. 2.
Figure 3:
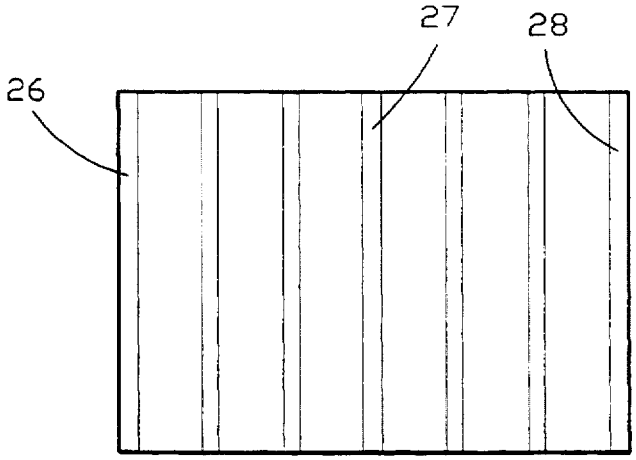
FIG. 3 is an end elevational view of the pouring buck of the present invention.
Figure 5:
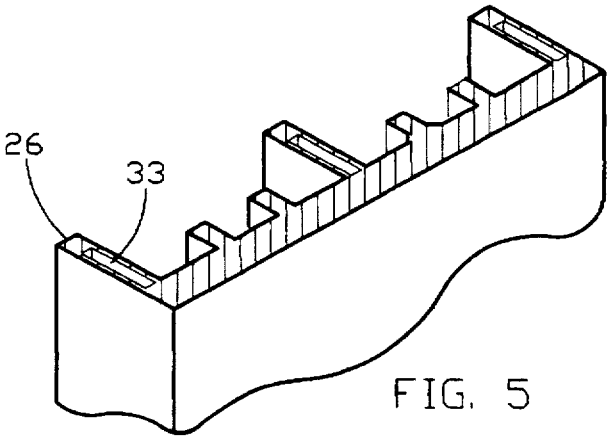
FIG. 5 is a fragmentary top plan view of a portion of the pouring buck of the present invention showing the insert-receiving holes in the pouring buck frame.

As can be seen more particularly in FIGS. 2, 3 and 4, the pouring buck includes a top horizontal member 22 and a bottom horizontal member 23 with a left sidewall member 24 and a right sidewall member 25.

Flanges 26, 27 and 28 are formed in the exterior surfaces of the portions 22, 23, 24 and 25 with the fins 26 and 28 forming a part of the faces 29 and 30.

It is these faces which can be molded to look like concrete or given whatever pictorial configuration is desired.

Additionally, a series of ribs 31 can also be formed in the walls 22, 23, 24 and 25 to provide more suitable interlocking and rigidifying features for engaging the concrete as it flows around the buck when the buck is in position in the forms which receive the flowing concrete.

Additionally, there is provided on the interior surfaces of the wall members 22, 23, 24, and 25 a groove 32 which can receive the window frame (not shown) after the concrete is set and the wall has been completed.

Also, desirably for additional construction features, there is provided in each of the flanges 26, 27 and 28 a rectangular hole 33 into which appropriate inserts 35 can be placed during factory assembly.

Figure 7:
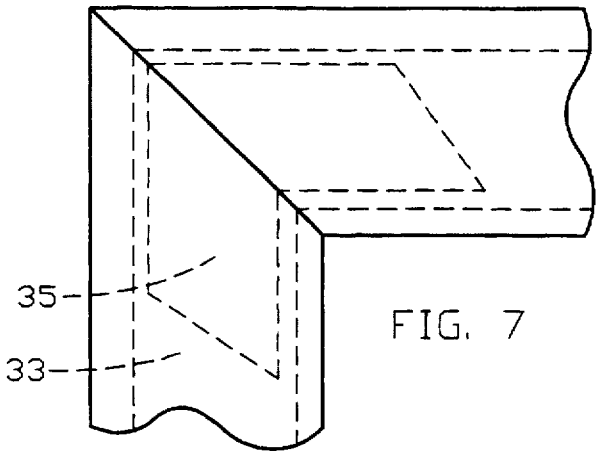
FIG. 7 is a fragmentary view of a corner of the buck of the present invention with an insert rigidly holding a corner together.
Figure 6:
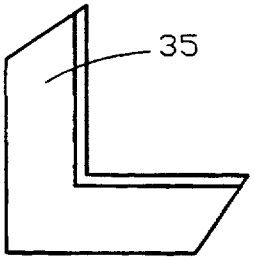
FIG. 6 is a perspective view of and insert used in the buck of the present invention.

This insert 35 shown in FIG. 6 can be a stamped steel insert which provides additional assembly strength as shown FIG. 7.

With regard to the materials of which the pouring buck is made, it is desirable to use a composite of sawdust and a polymer and more desirably a composition including about 70% sawdust and 30% polymer. Although the ratio of sawdust to polymer may vary slightly as, for instance, 25% polymer and 75% sawdust, or 35% polymer and 65% sawdust, the desirable ratio is 70% sawdust to 30% polymer.

A preferred polymer is polyethylene, although other polymers may be chosen, as long as they are compatible with the wood chips or sawdust.

The polymer, when cured, holds the sawdust in place, and the composite, even though it consists of 70% cellulose, resists the absorption of water from the concrete when the concrete is poured around the pouring buck.

Although the pouring buck of the present invention may be mechanically assembled or machined from strips of the composite sawdust and polymer, this is less efficient and substantially less desirable from an economical standpoint because of the waste of material. Therefore, by choosing a composite of sawdust and polymer which can be moulded or extruded into the shapes of which the cross-section is quite clearly shown in FIG. 4, the highly desirable pouring buck of the present invention can be created most effectively from extruded shapes having a cross-section similar to that shown in FIG. 4.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. A pouring buck comprising:

at least four sections, each said section having at least two flanges extending outward from an outside surface;

each said section being fabricated from a material having a combination of cellulose and polymer;

each said flange having a slot formed therein;

an insert being inserted into a slot in each said section, said sections being firmly joined together; and at least one pouring buck being included in a structural wall of poured concrete.

2. The pouring buck of claim 1, wherein:

said cellulose is between 60% and 80% by weight and said polymer is between 20% and 40% by weight.

3. The pouring buck of claim 1, further comprising:

said insert being L-shaped.

4. The pouring buck of claim 1, further comprising:

said insert being fabricated from metal.

5. The pouring buck of claim 1, further comprising:

at least one rib extending outward from said outside surface of each said section.

* * * * *